US011308933B2

(12) United States Patent
McCutcheon

(10) Patent No.: US 11,308,933 B2
(45) Date of Patent: Apr. 19, 2022

(54) NOISE CANCELLATION ENABLED AUDIO DEVICE AND NOISE CANCELLATION SYSTEM

(71) Applicant: ams AG, Premstaetten (AT)

(72) Inventor: Peter McCutcheon, Premstaetten (AT)

(73) Assignee: AMS AG, Premstätten (AT)

( * ) Notice: Subject to any disclaimer, the term of this patent is extended or adjusted under 35 U.S.C. 154(b) by 0 days.

(21) Appl. No.: 16/772,962

(22) PCT Filed: Dec. 14, 2018

(86) PCT No.: PCT/EP2018/085050
§ 371 (c)(1),
(2) Date: Jun. 15, 2020

(87) PCT Pub. No.: WO2019/121421
PCT Pub. Date: Jun. 27, 2019

(65) Prior Publication Data

US 2021/0166674 A1 Jun. 3, 2021

(30) Foreign Application Priority Data

Dec. 20, 2017 (EP) ..... 17208972

(51) Int. Cl.
*G10K 11/178* (2006.01)
*H04R 1/02* (2006.01)
*H04R 1/10* (2006.01)

(52) U.S. Cl.
CPC ..... *G10K 11/17881* (2018.01); *H04R 1/023* (2013.01); *H04R 1/1016* (2013.01);
(Continued)

(58) Field of Classification Search
None
See application file for complete search history.

(56) References Cited

U.S. PATENT DOCUMENTS 4,494,074 A 1/1985 Bose
5,182,774 A 1/1993 Bourk
(Continued)

FOREIGN PATENT DOCUMENTS

CN 102413403 A 4/2012
EP 2280557 A1 2/2011
WO 2015160477 A1 10/2015

OTHER PUBLICATIONS

European Patent Office, International Search Report for PCT/EP2018/085050 dated Feb. 14, 2019.
(Continued)

*Primary Examiner* — Kenny H Truong
(74) *Attorney, Agent, or Firm* — MH2 Technology Law Group LLP

(57) ABSTRACT

A noise cancellation enabled audio device, in particular a headphone, comprises a speaker which is arranged within the audio device and which has a preferential side for sound emission. The audio device further comprises a first cavity enclosing a first volume of air, where the first cavity is arranged at the preferential side for sound emission of the speaker, and an error microphone which is arranged within a second cavity within the audio device. The first cavity comprises a first opening to the outside of the audio device and the second cavity comprises a second opening to the outside of the audio device. The first and the second opening are both arranged on a side of the audio device which is arranged to face an ear canal of a user. Furthermore, a noise cancellation system is provided.

22 Claims, 6 Drawing Sheets

(52) U.S. Cl.
CPC ... *H04R 1/1075* (2013.01); *G10K 2210/1081* (2013.01); *G10K 2210/3026* (2013.01); *G10K 2210/3027* (2013.01)

(56) References Cited

U.S. PATENT DOCUMENTS

| | | | | |
|---|---|---|---|---|
| 8,737,669 | B2 | 5/2014 | Monahan et al. | |
| 9,082,388 | B2 | 7/2015 | Annunziato et al. | |
| 2013/0028435 | A1* | 1/2013 | Christoph ..... | G10K 11/17817 381/71.6 |
| 2013/0216060 | A1 | 8/2013 | Narayan et al. | |
| 2013/0336513 | A1 | 12/2013 | Darlington | |
| 2014/0294182 | A1 | 10/2014 | Axelsson et al. | |
| 2015/0243271 | A1 | 8/2015 | Goldstein | |
| 2016/0302000 | A1 | 10/2016 | Shin | |
| 2017/0358291 | A1 | 12/2017 | Cheng et al. | |

OTHER PUBLICATIONS

Chinese Search Report (with English Translation) in corresponding CN Application No. 201880081179 dated Sep. 23, 2021, 6 pages.
Chinese First Office Action (with English Translation) in corresponding CN Application No. 201880081179 dated Sep. 28, 2021, 11 pages.

* cited by examiner

NOISE CANCELLATION ENABLED AUDIO DEVICE AND NOISE CANCELLATION SYSTEM

CROSS-REFERENCE TO RELATED APPLICATIONS

The present application is the national stage entry of International Patent Application No. PCT/EP2018/085050, filed on Dec. 14, 2018, which claims the benefit of priority of European Patent Application No. 17208972.4, filed on Dec. 20, 2017, all of which are hereby incorporated by reference in their entirety for all purposes.

BACKGROUND OF THE INVENTION

Noise cancellation in an audio device as for example a headphone can be improved by creating a seal between the audio device and an ear of a user, such that there is no or only a small controlled leak between the audio device and the ear canal wall of the user. If no leak is present between the audio device and the ear canal wall of the user, the volume in front of the feedback microphone within the audio device and the volume within the ear canal of the user behave like one acoustic volume. In this case a feedback microphone of the audio device is closely coupled to the volume within the ear canal of the user, and therefore to the eardrum. Consequently, feedback noise cancellation with a good quality can be achieved.

However, it might be preferred not to form a seal between the audio device and the ear canal of the user or it is possible that the audio device does not perfectly fit for each user. If a leak between the audio device and the ear canal wall exists, more sound from outside of the audio device can reach the ear canal and the acoustic system changes. Furthermore, if the user is moving, the audio device might change its position within the ear canal of the user which again changes the acoustic system. Because of the leak, the acoustic coupling between the feedback microphone of the audio device and the ear canal of the user is reduced. This means, noise cancellation with a good quality can be achieved at the location of the feedback microphone but the attenuation might be different within the ear canal of the user. Sound is perceived at the ear drum which is arranged within the ear canal. Thus, the user might only hear a noise cancellation with a reduced quality.

SUMMARY OF THE INVENTION

This disclosure provides a noise cancellation enabled audio device with an increased quality of noise cancellation. This disclosure further provides a noise cancellation system with an increased quality of noise cancellation.

In at least one embodiment of the noise cancellation enabled audio device, the audio device comprises a speaker which is arranged within the audio device and which has a preferential side for sound emission. The audio device can be for example a headphone or an earphone, in particular an in-ear headphone. The audio device can comprise a housing in which the speaker is arranged. The speaker can have a front side which can be the preferential side for sound emission. This means, the sound emitted by the speaker can be perceived preferably at the front side. The speaker can further have a back side which faces away from the front side.

The audio device further comprises a first cavity enclosing a first volume of air, where the first cavity is arranged at the preferential side for sound emission of the speaker. The first cavity can be arranged within the housing of the audio device or it can be at least partially surrounded by the housing. This means, the first volume of air can be at least partially surrounded by the housing. That the first cavity encloses the first volume of air means, that within the first volume of air no other parts of the audio device are arranged and that the first cavity can be filled with air from the surroundings of the audio device. That the first cavity is arranged at the preferential side for sound emission of the speaker means that the speaker is arranged next to the first volume of air. Furthermore, the first volume of air is arranged at the preferential side for sound emission of the speaker.

The audio device further comprises an error microphone which is arranged within a second cavity within the audio device. The error microphone can be arranged to record sound that reaches the error microphone. The second cavity can be separated from the first cavity by a separating wall within the audio device. The second cavity can enclose a second volume of air.

The first cavity comprises a first opening to an outside of the audio device and the second cavity comprises a second opening to the outside of the audio device. The first opening can be formed within the housing. Via the first opening the first volume of air can be in direct contact with air from the surroundings of the audio device. This means, the first volume of air can be in direct contact with air from the surroundings of the audio device via the first opening and not via the second cavity. The first opening can be the only opening of the first cavity to the outside of the audio device. It is further possible that the first cavity comprises more than one opening to the outside of the audio device. The first cavity can be free of an opening to the second cavity.

The second opening can be formed within the housing. Via the second opening the second volume of air can be in direct contact with air from the surroundings the audio device. This means, the second volume of air can be in direct contact with air from the surroundings of the audio device via the second opening and not via the first cavity. The second volume of air can be acoustically coupled to the first volume of air via the volume of air within the ear canal. Thus, also the error microphone is acoustically coupled to the first volume of air via the volume of air within the ear canal. The second cavity can be free of an opening to the first cavity.

The first cavity and the second cavity can be arranged adjacent to each other within the audio device. Furthermore, the first opening and the second opening can be arranged adjacent to each other. The first and the second opening are arranged in such a way that the first volume of air and the second volume of air can be in direct contact with the air within the ear canal of a user if the audio device is arranged within that ear canal of the user.

The first and the second opening are both arranged on a side of the audio device which is arranged to face an ear canal of a user. This means, the first and the second opening can be arranged at a side of the audio device which faces the ear canal of the user if the audio device is arranged within the ear canal of the user. It is further possible that the first opening is arranged to face the ear drum of the user if the audio device is arranged within the ear canal of the user. Furthermore, the second opening can be arranged to face the ear drum of the user if the audio device is arranged within the ear canal of the user. The first opening and the second opening can be parallel to each other. It is further possible that the first opening is arranged to face a different part of the ear canal of a user than the second opening. The first opening and the second opening can further face different directions, this means, they can be arranged such that they are not parallel to each other.

As the error microphone is arranged within the second cavity it can record sound from the ear canal of a user. By arranging the error microphone in the second cavity, which is separated from the first cavity with the speaker, the second volume of air is directly coupled to the volume of air within the ear canal. In this way, the error microphone can monitor the sound which reaches the ear canal. Sound from the speaker can reach the ear canal and furthermore sound from the outside of the audio device can reach the ear canal. The sound from the outside of the audio device can be perceived as disturbing noise by the user during listening to the sound from the speaker. Therefore, the error microphone is capable of detecting not only the sound from the speaker but also the noise from the outside of the audio device which reaches the ear canal. If the error microphone was arranged within the first cavity, it would directly record the sound from the speaker and the sound from the outside of the audio device would be shaped as it enters the ear canal and subsequently the first cavity. This shaping is different depending on the leakage between the audio device and the ear canal wall.

This means, by arranging the error microphone within the second cavity advantageously the sound from the speaker and the noise from outside of the audio device within the ear canal can be monitored.

By monitoring the sound within the ear canal it is possible to adapt the noise cancellation according to the sound pressure level of the noise from the outside of the audio device within the ear canal. This is achieved by arranging the error microphone within the second cavity. In other words, by arranging the error microphone within the second cavity the error microphone is acoustically coupled to the ear drum of the ear of the user.

In at least one embodiment of the noise cancellation enabled audio device, once the audio device is placed in the ear canal of a user a channel remains in places between the audio device and the ear canal of the user. This means, the audio device does not form a perfect seal with the ear canal walls of the user. Once the audio device is placed in the ear canal of the user sound from the outside of the audio device can enter the ear canal through the channel which remains between the audio device and the ear canal. It is possible that the audio device is in direct contact with the ear canal walls of the user in places. However, in some places the audio device is not in direct contact with the ear canal walls once the audio device is placed in the ear canal of the user. These places are referred to by the channel. The channel can for example remain between the audio device and the ear canal of the user as the shape of the ear canal of different users might be different such that the audio device cannot perfectly fit in the ear canal of each user. Air from the outside of the audio device can enter the ear canal through the channel. Therefore, it is also possible that sound from the outside of the audio device can enter the ear canal via the channel.

The sound entering the ear canal via the channel can be recorded by the error microphone. Thus, the error microphone can monitor the sound entering the ear canal from the outside. The sound entering the ear canal from the outside might be disturbing or annoying during listening to the sound provided by the speaker of the audio device. This is why the audio device is arranged to cancel the noise from outside of the audio device. By arranging the error microphone in the second cavity the quality of the noise cancellation can be improved as the noise cancellation can be adapted according to the sound entering the ear canal.

In at least one embodiment of the noise cancellation enabled audio device, the channel is permeable for air and sound waves. This means, once the audio device is placed in the ear canal of a user the cavity formed within the ear canal is not closed but air and sound from outside of the audio device can leak into the cavity within the ear canal. A volume of air remains within the ear canal once the audio device is placed within the ear canal and the volume of air within the ear canal is coupled to the outside of the audio device via the channel. Furthermore, the volume of air within the ear canal is coupled to the first volume of air and to the second volume of air. As the error microphone is arranged within the second cavity and as it is arranged to record sound entering the ear canal it is possible to obtain noise cancellation with a good quality even though noise from the outside of the audio device can enter the ear canal.

In at least one embodiment of the noise cancellation enabled audio device, the second opening is the only opening in the second cavity. This means, that the second cavity does not have a direct connection to the first cavity. For example the first cavity and the second cavity can be separated from each other by a separating wall. Sound and air from the outside of the second cavity can primarily enter the second cavity through the second opening. Consequently, the error microphone can record the sound that enters the ear canal for example from the outside of the audio device or from the speaker and the quality of the noise cancellation can be improved in the ear canal.

In at least one embodiment of the noise cancellation enabled audio device, the second cavity encloses a second volume of air which is directly coupled to a volume of air within the ear canal of a user in case that the audio device is placed within the ear canal of the user. This means, the second volume of air is in direct contact with the volume of air within the ear canal. Thus, the error microphone can record the sound which enters the volume of air within the ear canal and the quality of the noise cancellation can be improved.

In at least one embodiment of the noise cancellation enabled audio device, a mesh is arranged over the first opening. The mesh can completely cover the first opening. The mesh can be permeable for sound and air. The mesh can for example be a grid. As an example the mesh can be formed by fabric or foam. The mesh can be arranged to prevent dust and dirt from entering the first cavity or to reduce the amount of dust or dirt entering the first cavity. The mesh may have an acoustic impedance.

In at least one embodiment of the noise cancellation enabled audio device, a mesh is arranged over the second opening. The mesh can completely cover the second opening. The mesh can be permeable for sound and air. The mesh can for example be a grid. As an example the mesh can be formed by fabric or foam. The mesh can be arranged to prevent dust and dirt from entering the second cavity or to reduce the amount of dust or dirt entering the second cavity. The mesh may have an acoustic impedance.

In at least one embodiment of the noise cancellation enabled audio device, the error microphone is arranged to primarily record sound within the ear canal of a user. As the second volume of air is directly coupled to the volume of air within the ear canal, the acoustic conditions within the second cavity are very similar to the acoustic conditions within the ear canal of the user. The acoustic conditions within the ear canal of the user relate to the sound perceived by the user since sound is perceived at the ear drum within the ear canal. The error microphone can be arranged very close to the volume of air within the ear canal. Therefore, the error microphone can primarily record the sound within the ear canal of the user which is representative of the sound perceived by the user at the ear drum. Advantageously, the error microphone is thus capable of monitoring the sound within the ear canal of the user which enables an improved quality of the noise cancellation.

In at least one embodiment of the noise cancellation enabled audio device, the error microphone acts as a feedback microphone. This means, the error microphone records the sound pressure level within the second cavity which corresponds to or is similar to the sound pressure level within the ear canal of the user. Based on the sound recorded by the error microphone an error signal can be provided. In order to perform noise cancellation the speaker can provide a noise cancellation signal which is based on the error signal. The noise cancellation signal can be arranged to cancel or reduce the perceived amplitude of the noise from outside of the audio device. This means, if the speaker provides the noise cancellation signal, the noise from outside of the audio device and the noise cancellation signal can cancel each other or nearly cancel each other at the position of the ear canal of the user. Consequently, the user does not perceive the noise entering the ear canal from outside of the audio device or the amplitude of the noise perceived by the user is reduced. Therefore, the error microphone can be employed for feedback noise cancellation.

In order to improve the quality of the noise cancellation for an error microphone which acts as a feedback microphone, the error microphone is arranged as close to the speaker as possible. This reduces the latency from the speaker to the error microphone, since the error microphone needs to record the sound from the speaker as well. Moreover, in this way the bandwidth of the feedback noise cancellation is improved.

In at least one embodiment of the noise cancellation enabled audio device, the error microphone is arranged within the second opening at least partially such that the error microphone terminates flush with the housing of the audio device. This means, the error microphone can be arranged as close as possible to the outside of the audio device. That the error microphone terminates flush with the housing of the audio device can mean that the error microphone does not stick out of the audio device. Advantageously, the error microphone is in this way directly coupled to the sound within the ear canal.

In at least one embodiment of the noise cancellation enabled audio device, a feed-forward microphone is arranged at a side of the audio device which faces away from the side where the error microphone is arranged. This can mean that the feed-forward microphone is ported to the outside of the audio device. The feed-forward microphone can be arranged to record sound from the outside of the audio device. Therefore, the feed-forward microphone is arranged at a position of the audio device where it can record sound from the outside of the audio device. As the error microphone is arranged at the side of the audio device which faces the ear canal, the feed-forward microphone is arranged at a side which faces away from the side where the error microphone is arranged. It is further possible that the feed-forward microphone is arranged at any other position of the audio device where it can record sound from the outside of the audio device. The feed-forward microphone can be employed for feed-forward noise cancellation.

In at least one embodiment of the noise cancellation enabled audio device, the feed-forward microphone is arranged to record sound from the environment of the audio device and to provide a noise signal related to the recorded sound. In order to perform the feed-forward noise cancellation it is necessary to record the sound from the environment of the audio device which might disturb a user while listening to the sound provided by the speaker. Therefore, the feed-forward microphone is arranged to record sound from the environment of the audio device. The feed-forward microphone can be arranged within the audio device or at an outer surface of the audio device such that it is capable of recording sound from the environment of the audio device. In order to perform noise cancellation the feed-forward microphone provides the noise signal. The noise signal can for example comprise information about the sound recorded by the feed-forward microphone. The noise signal can be provided to a noise cancellation system of the audio device in order to perform noise cancellation. The quality of the noise cancellation can be improved by employing both the error microphone and the feed-forward microphone.

Furthermore, a noise cancellation system is provided. In at least one embodiment of the noise cancellation system, the noise cancellation system comprises the audio device. The noise cancellation system can be arranged to perform noise cancellation for the audio device.

In at least one embodiment of the noise cancellation system, the noise cancellation system further comprises a filter which is coupled between the feed-forward microphone and the speaker. The feed-forward microphone can be connected with the filter and the filter can be connected with the speaker. The filter can be arranged within the audio device.

In at least one embodiment of the noise cancellation system, the filter is arranged to provide a noise cancellation signal based on the noise signal to the speaker. The feed-forward microphone can be arranged to provide a noise signal to the filter. The filter can be arranged to generate a noise cancellation signal. The noise cancellation signal can be based on the noise signal and it is provided to the user by the speaker. For example, the noise cancellation signal can be generated in such a way that the noise from outside of the audio device perceived at the position of the ear canal cancels with the noise cancellation signal. It is further possible that the noise cancellation signal and the noise from outside of the audio device perceived in the ear canal nearly cancel each other, such that a user perceives the noise from outside of the audio device with a reduced amplitude. After generating the noise cancellation signal the filter can provide the noise cancellation signal to the speaker. In this case, the speaker can provide both the noise cancellation signal and a sound signal which is to be provided to the user. The sound signal can be for example music or a voice signal to be heard by the user. Thus, the noise cancellation signal and the noise from outside of the audio device can cancel each other or the amplitude of the noise perceived by the user can be reduced such that the user can listen to the sound signal.

In at least one embodiment of the noise cancellation system, the noise cancellation signal is further based on an error signal provided by the error microphone where the error signal is related to the sound recorded by the error microphone. The error microphone can be arranged to provide the error signal. The error signal can comprise information about the sound recorded by the error microphone which can be sound from outside of the audio device leaking into the ear canal and the sound provided by the speaker. The error signal can be provided to the filter. Therefore, the filter can generate the noise cancellation signal based on both the noise signal and the error signal.

This means, the noise signal can provide information about the sound present outside of the audio device and the error signal can provide information about the sound pressure level within the ear canal. The noise cancellation signal can be adapted according to the level of noise reaching the ear canal. Thus, adaptive noise cancellation can be performed. In this way, the quality of the noise cancellation can be improved.

BRIEF DESCRIPTION OF THE DRAWINGS

The following description of figures may further illustrate and explain exemplary embodiments. Components that are functionally identical or have an identical effect are denoted by identical references. Identical or effectively identical components might be described only with respect to the figures where they occur first. Their description is not necessarily repeated in successive figures.

DETAILED DESCRIPTION

Figure 1:
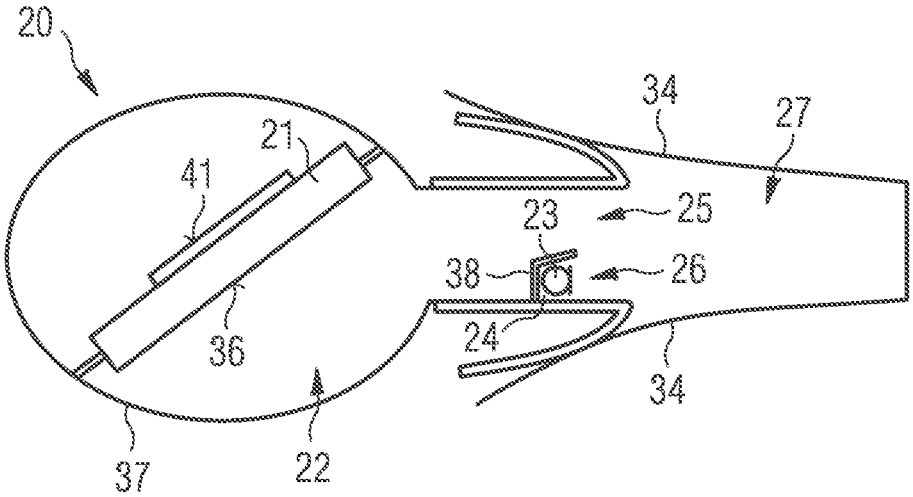
In FIGS. 1, 2, 3 and 4 exemplary embodiments of an audio device are shown.

In FIG. 1 an exemplary embodiment of a noise cancellation enabled audio device 20 is shown. In this case the audio device 20 is a headphone. The audio device 20 is shown to be placed within an ear canal 27 of a user. The audio device 20 is shaped in such a way that a seal can be formed between the audio device 20 and the ear canal walls 34. However, it might be possible that a leak is present between the audio device 20 and the ear canal walls 34 at some places which is not shown in FIG. 1. It is further possible that the audio device 20 does not form a seal with differently shaped ear canals 27.

The audio device 20 comprises a speaker 21 which is arranged within the audio device 20 and which has a preferential side 36 for sound emission. The speaker 21 further comprises a back side 41 which faces away from the preferential side 36 for sound emission. A first cavity 22 enclosing a first volume of air is arranged at the preferential side 36 for sound emission of the speaker 21. The first cavity 22 is delimited by the speaker 21, a housing 37 of the audio device 20 and a first opening 25 to the outside of the audio device 20. The first opening 25 is arranged at the side of the audio device 20 which faces the ear canal 27. Via the first opening 25 the first volume of air is acoustically coupled to the volume of air within the ear canal 27. The audio device 20 can further comprise a vent or an opening within the housing 37 which is not shown in FIG. 1 and which is in contact with the volume of air at the back side 41 of the speaker 21 such that a membrane of the speaker 21 can move.

The audio device 20 further comprises an error microphone 23 which is arranged within a second cavity 24 within the audio device 20. The second cavity 24 is separated from the first cavity 22 by a separating wall 38. The error microphone 23 is arranged to primarily record sound within the ear canal 27. The second cavity 24 is delimited by the separating wall 38, the housing 37 and a second opening 26 to the outside of the audio device 20. The second opening 26 is arranged to face the ear canal 27 as well.

Figure 2:
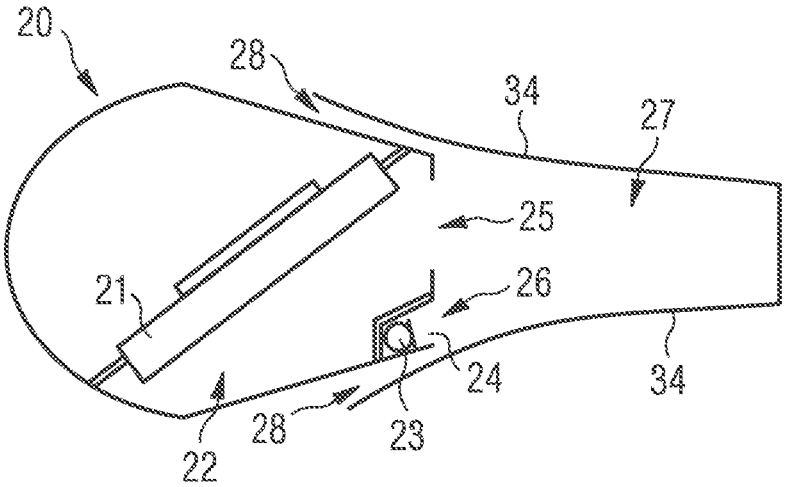

In FIG. 2 a further embodiment of the audio device 20 is shown. In this case the audio device 20 is shaped in such a way that once it is placed in the ear canal 27 of a user, a channel 28 remains between the audio device 20 and the ear canal 27 in places. This means, in some places no seal is formed between the audio device 20 and the ear canal walls 34 if the audio device 20 is placed within the ear canal 27. The channel 28 can be arranged in places between the audio device 20 and the ear canal walls 34. The channel 28 is permeable for air and sound waves, which means that sound from the outside of the audio device 20 can enter the ear canal 27 via the channel 28.

The setup of the speaker 21, the first cavity 22, the second cavity 24 and the error microphone 23 is as shown in FIG. 1. The second opening 26 is the only opening in the second cavity 24. This means, a second volume of air within the second cavity 24 is directly coupled to the volume of air within the ear canal 27. Furthermore, the second volume of air is coupled to the first volume of air within the first cavity 22 via the volume of air within the ear canal 27.

The error microphone 23 arranged within the second cavity 24 can act as a feedback microphone. The error microphone 23 records the noise entering the ear canal 27 from outside of the audio device 20 and the signal from the speaker 21. By supplying an error signal comprising information about the noise recorded by the error microphone 23 a noise cancellation signal can be generated and supplied by the speaker 21. The noise cancellation signal is generated in such a way that it can cancel or nearly cancel with the noise entering the ear canal 27.

Figure 3:
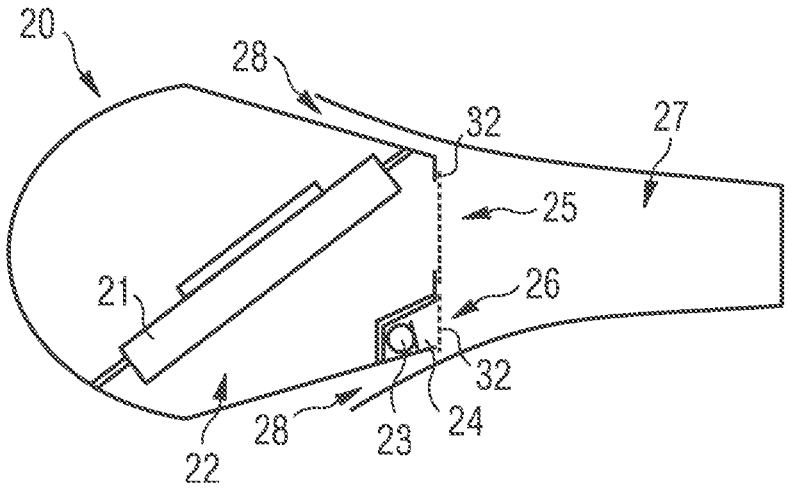

In FIG. 3 a further embodiment of the audio device 20 is shown. The setup of the audio device 20 is similar to the setup shown in FIG. 2. In addition to the setup shown in FIG. 2 the audio device 20 shown in FIG. 3 comprises a mesh 32 which is arranged over the first opening 25. Furthermore, a further mesh 32 is arranged over the second opening 26. In other embodiments the audio device 20 can comprise either a mesh 32 arranged over the first opening 25 or a mesh 32 arranged over the second opening 26. The meshes 32 can be permeable for sound and air. As an example the meshes 32 can be formed by fabric or foam. The meshes 32 can be arranged to prevent dust and dirt from entering the first cavity 22 and/or the second cavity 24 or to reduce the amount of dust or dirt entering the cavities 22, 24.

Figure 4:
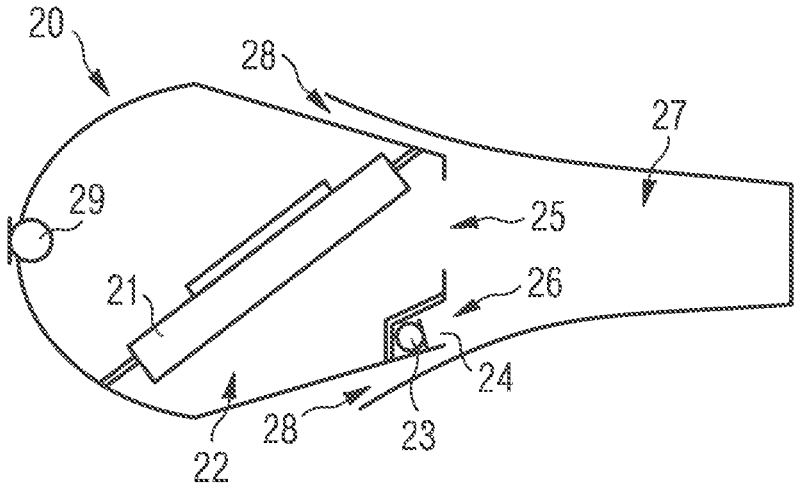

In FIG. 4 a further embodiment of the audio device 20 is shown. The setup of the audio device 20 is similar to the setup shown in FIG. 2. The audio device 20 shown in FIG. 4 further comprises a feed-forward microphone 29. The feed-forward microphone 29 is arranged at a side of the audio device 20 which faces away from the side where the error microphone 23 is arranged. By employing a feed-forward microphone 29 feedforward noise cancellation can be realized. One possibility to implement feedforward noise cancellation in the audio device 20 is explained with FIG. 5.

Figure 5:
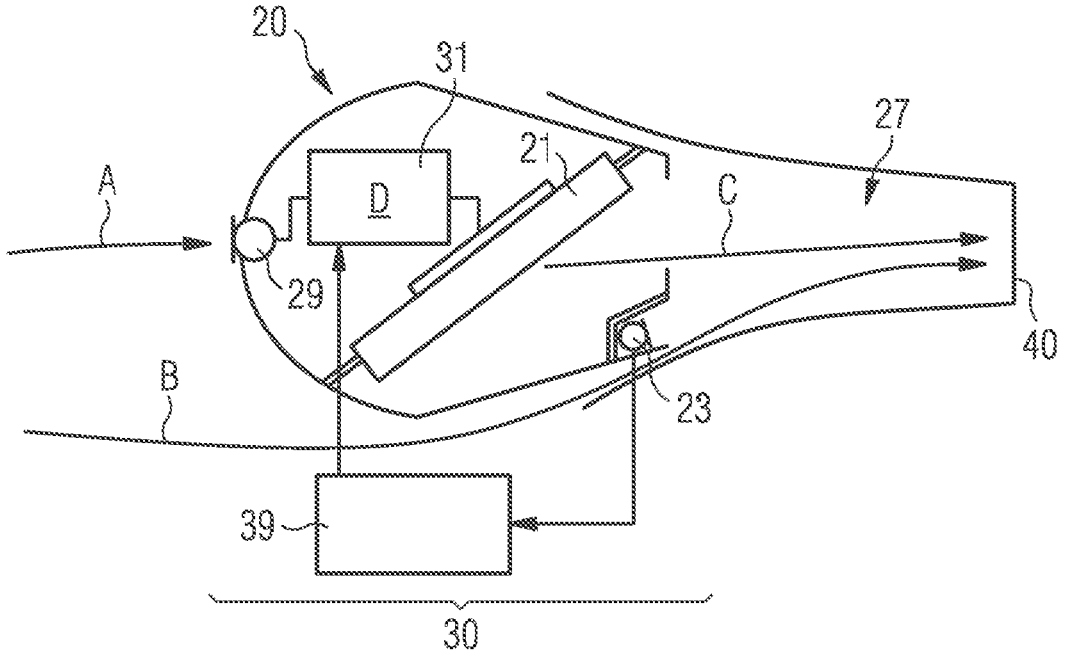
In FIGS. 5 and 6 an exemplary embodiment of a noise cancellation system with an audio device is shown.

In FIG. 5 a further embodiment of the audio device 20 and a noise cancellation system 30 are shown. The noise cancellation system 30 comprises the audio device 20. The setup of the audio device 20 is similar to the setup shown in FIG. 4. The noise cancellation system 30 further comprises a filter 31 which is coupled between the feed-forward microphone 29 and the speaker 21. The feed-forward microphone 29 is arranged to record sound from the environment of the audio device 20 and to provide a noise signal related to the recorded sound. The filter 31 is arranged to provide a noise cancellation signal based on the noise signal to the speaker 21. The noise cancellation signal is generated in such a way that noise entering the ear canal 27 and the noise cancellation signal cancel each other or nearly cancel each other at an ear drum 40 of the ear of the user which is where humans perceive sound. The noise cancellation system 30 shown in FIG. 5 further comprises an adaptive engine 39 which is connected between the error microphone 23 and the filter 31. The adaptive engine 39 provides the error signal which is related to the sound recorded by the error microphone 23 to the filter 31. This means, the noise cancellation signal is further based on the error signal.

The generation of the noise cancellation signal can be described with the acoustic transfer functions of the noise which can be present in the environment of the audio device 20. The acoustic transfer functions are frequency domain transfer functions. The transfer function A refers to the transfer function of the noise from the environment of the audio device 20 which reaches the feed-forward microphone 29. In FIG. 5 the transfer function A is illustrated with an arrow pointing to the feed-forward microphone 29. The transfer function B refers to the transfer function of the noise from the environment of the audio device 20 which reaches the ear drum 40. The transfer function B is illustrated with an arrow pointing from the outside of the audio device 20 towards the ear drum 40. Furthermore, the transfer function C refers to the transfer function of the sound emitted by the speaker 21 and reaching the ear drum 40. The transfer function C is illustrated with an arrow pointing from the speaker 21 towards the ear drum 40. The transfer function of the filter 31 is referred to as transfer function D.

The condition for noise cancellation which can be perceived by a user is that the noise cancellation signal is equal in amplitude and opposite in phase to the noise entering the ear canal 27. This condition can be expressed by the four transfer functions as follows:

$$B=-A*D*C \tag{1}$$

The term on the right side of the equation refers to the overall transfer function from the outside of the audio device 20 towards the ear drum 40. It follows for the transfer function D of the filter 31:

$$D=-B/(A*C) \tag{2}$$

If more noise can enter the ear canal 27 through the channel 28 the transfer functions B and C are changed. The error signal recorded by the error microphone 23 provides information about the noise entering the ear canal 27 through the channel 28. This information is provided to the filter 31 by the adaptive engine 39. Consequently, the transfer function D of the filter 31, which depends on the transfer functions B and C, can be adapted according to the error signal.

In order to adapt the transfer function D of the filter 31 according to the noise entering the ear canal 27 it is necessary to know the noise perceived by the user. The user perceives the noise entering the ear canal 27 at the ear drum 40. As described above the error microphone 23 is directly coupled to the volume of air within the ear canal 27 which means that the sound recorded by the error microphone 23 is very similar to the sound perceived by the user at the ear drum 40. The information provided by the error microphone 23 about the noise entering the ear canal 27 is provided to the filter 31 in order to improve the quality of the noise cancellation.

Figure 6:
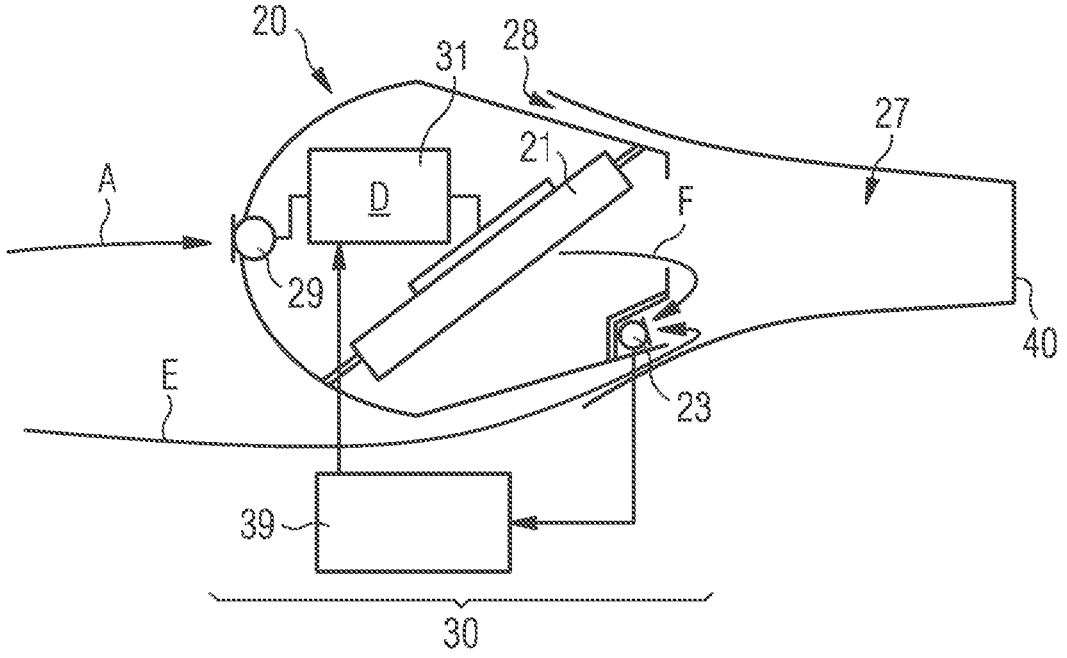

With FIG. 6 it is illustrated that the sound recorded by the error microphone 23 is comparable to the sound perceived at the ear drum 40. In FIG. 6 the same setup of the noise cancellation system 30 and the audio device 20 as in FIG. 5 is shown. In order to compare the sound recorded by the error microphone 23 to the sound perceived by the user at the ear drum 40 the transfer functions towards the error microphone 23 are illustrated. The transfer function E relates to the noise entering the ear canal 27 and being recorded at the position of the error microphone 23. The transfer function F relates to the sound provided by the speaker 21 and recorded at the position of the error microphone 23. This means, the transfer function E differs from the transfer function B depicted in FIG. 5 by the distance from the error microphone 23 to the ear drum 40. The transfer function F differs from the transfer function C depicted in FIG. 5 by the distance from the error microphone 23 to the ear drum 40 as well. Consequently, this difference in distance cancels in equation 2. Therefore, the sound recorded by the error microphone 23 is very similar to the sound perceived at the ear drum 40.

Figure 7:
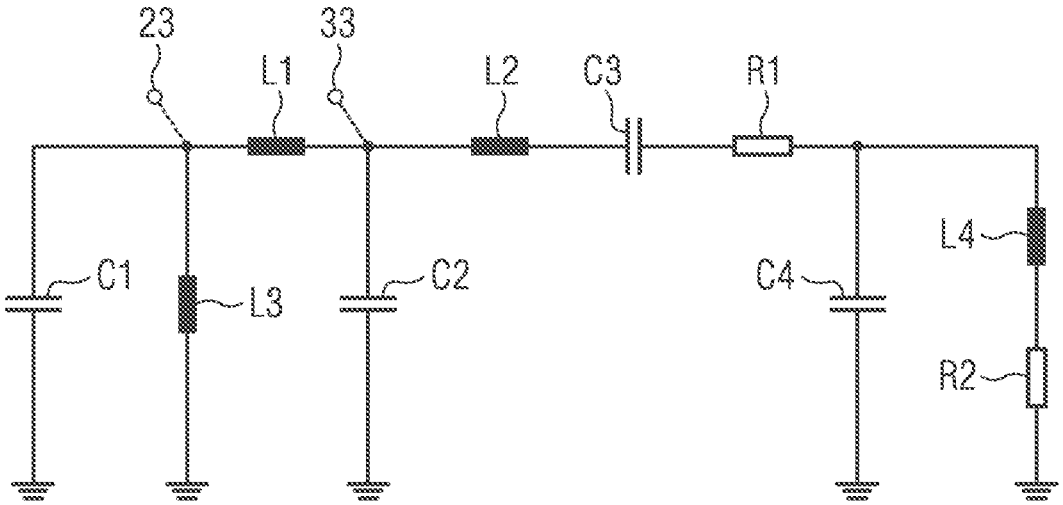
In FIGS. 7 and 8 electronic representations of a lumped parameter acoustic model of exemplary embodiments of an audio device are shown.

In FIG. 7 an electronic representation of a lumped parameter acoustic model of an exemplary embodiment of the audio device 20 is shown. As a comparison, furthermore a feedback microphone 33 is shown. The first capacitance C1 refers to the ear canal impedance. The second capacitance C2 refers to the first volume of air within the first cavity 22. The first inductance L1 refers to the first opening 25. The second inductance L2, the third capacitance C3 and the first resistance R1 together refer to the acoustic impedance of the speaker 21. The position of a feedback microphone 33 is shown which is usually arranged close to the speaker 21 within the first cavity 22 in systems for feedback noise cancellation. In comparison, the error microphone 23 of the audio device 20 described herein is arranged within the second cavity 24 which is closer to the ear canal 27 than the common position of a feedback microphone 33. Within the second cavity 24 the error microphone 23 is arranged within the second opening 26 at least partially such that the error microphone 23 terminates flush with the housing 37 of the audio device 20. In this way the error microphone 23 is directly coupled to the sound within the ear canal 27 as shown by the direct connection from the error microphone 23 to the first capacitance C1. Between the feedback microphone 33 and the ear canal 27 the first opening 25 is arranged. The ear drum 40 is arranged within the ear canal 27. Therefore, the feedback microphone 33 is coupled to the ear drum 40 via the first inductance L1.

However, if a leak is present between the audio device 20 and the ear canal 27, sound from the outside can enter the ear canal 27. An acoustic leak between the audio device 20 and the ear canal walls 34 is represented by a third inductance L3. Thus, the feedback microphone 33 would be less coupled to the ear drum 40 if an acoustic leak was present. With the feedback microphone 33 being arranged within the first cavity 22 the noise cancellation signal would be generated in such a way that noise cancellation would be achieved at the position of the feedback microphone 33 within the first cavity 22. However, a noise cancellation at the ear drum 40 might not be achieved. The error microphone 23 of the audio device 20 described herein is arranged closer to the ear canal 27. It is therefore better coupled to the ear drum 40 and a noise cancellation perceived by the user can be achieved.

The fourth capacitance C4 refers to the impedance of a volume of air which is arranged at the back side 41 of the speaker 21. The fourth inductance L4 and the second resistance R2 refer to a further opening which can be arranged within the housing 37 at the back side 41 of the speaker 21.

The further opening can be arranged within the housing 37 of the audio device 20 in order to form a vent at the back side 41 of the speaker 21.

Figure 8:
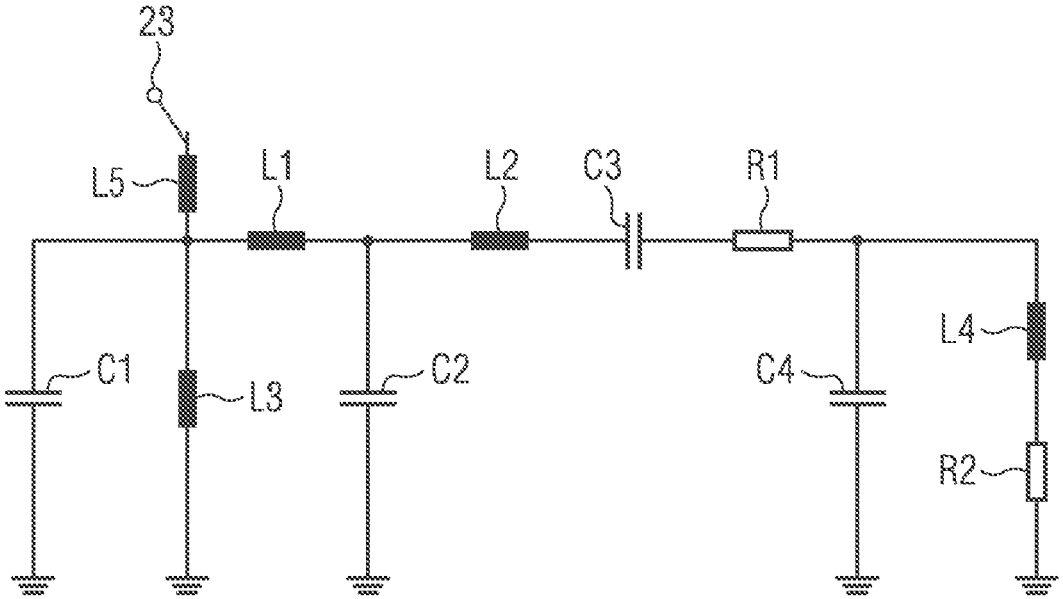

In FIG. 8 a further electronic representation of a lumped parameter acoustic model of an exemplary embodiment of the audio device 20 is shown. This model takes into account that the error microphone 23 is arranged within the second cavity 24 and not directly within the ear canal 27. The second cavity 24 has a second opening 26. The second opening 26 is represented by the fifth inductance L5.

Figure 9:
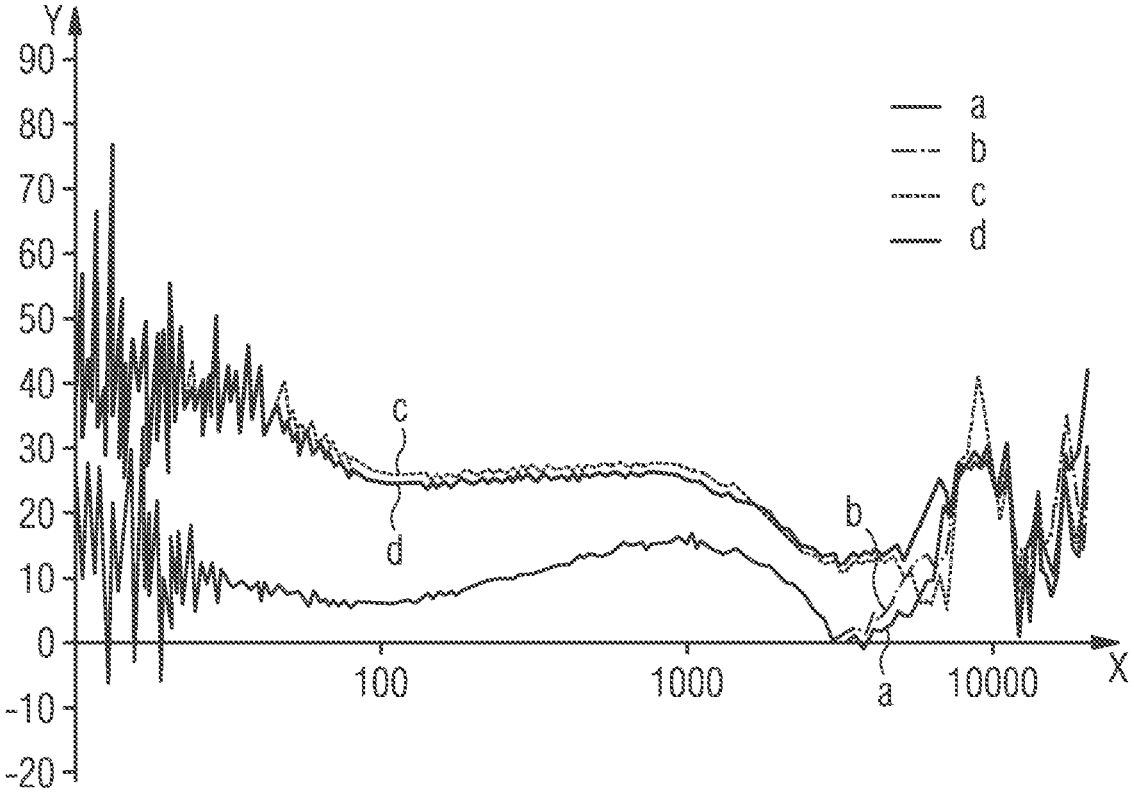
In FIGS. 9 and 10 the acoustic response of exemplary embodiments of the audio device are plotted.

In FIG. 9 the acoustic response of an exemplary embodiment of the audio device 20 is plotted. The acoustic response refers to the transfer function from outside of the audio device 20 towards either the position of the error microphone 23 or to the ear drum 40. In FIG. 9 the frequency is plotted in Hz on the x-axis and the amplitude of the acoustic response is plotted in arbitrary units on the y-axis. The curves a and b relate to the situation that no leak or only a small leak is present between the audio device 20 and the ear canal walls 34. Curves c and d relate to the situation that a perceivable leak is present between the audio device 20 and the ear canal walls 34. For curves c and d the acoustic mass of the channel 28 amounts to 433 $kg/m^4$. Furthermore, curves a and c relate to the transfer function to the position of the ear drum 40 and curves b and d relate to the transfer function to the position of the error microphone 23.

FIG. 9 shows that the acoustic response at the position of the error microphone 23 is very similar to the acoustic response at the position of the ear drum 40 for two different leakage conditions and over a wide range of frequencies. This is why by arranging the error microphone 23 in a separate cavity the quality of the noise cancellation can be improved.

Figure 10:
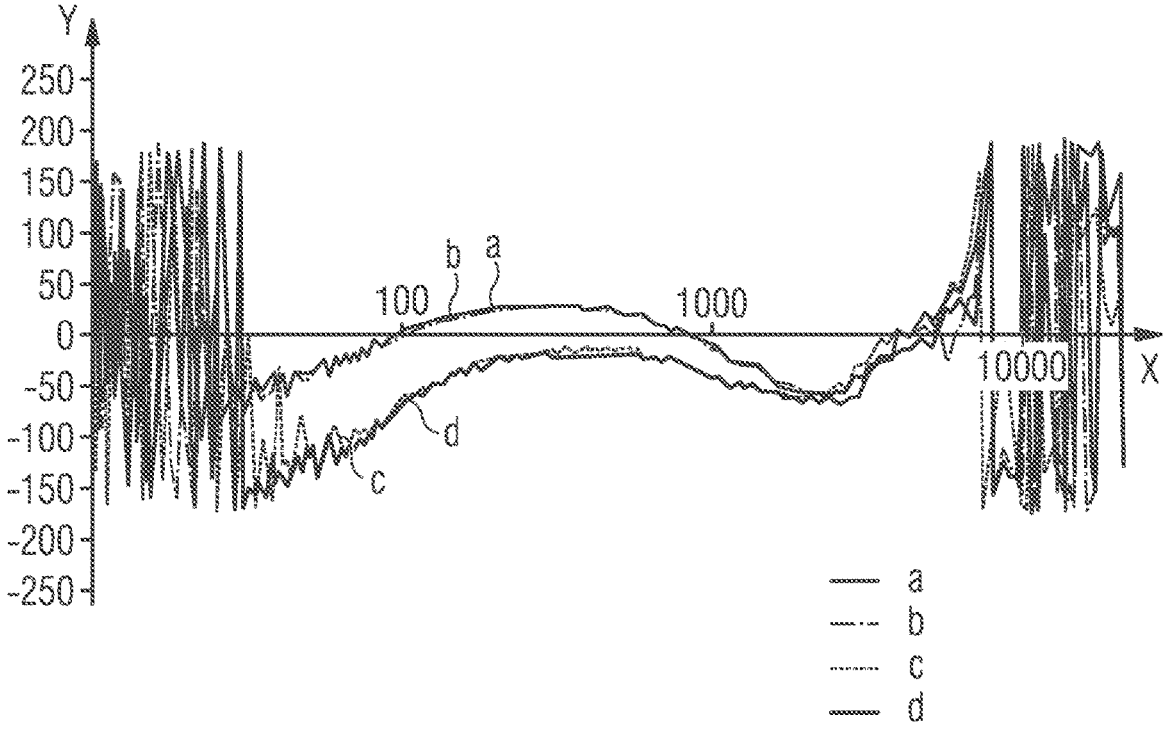

In FIG. 10 the phase of the acoustic response shown in FIG. 9 is plotted. On the x-axis the frequency is plotted in Hz and on the y-axis the phase is plotted in degrees. As in FIG. 9 curves a and b relate to the situation that no leak or only a small leak is present between the audio device 20 and the ear canal walls 34. Curves c and d relate to the situation that a perceivable leak is present between the audio device 20 and the ear canal walls 34. For curves c and d the acoustic mass of the channel 28 amounts to 433 $kg/m^4$.

Furthermore, curves a and c relate to the phase of the acoustic response at the position of the ear drum 40 and curves b and d relate to the phase of the acoustic response at the position of the error microphone 23. Similar to the amplitude of the acoustic response, the phase of the acoustic response is very similar at the position of the error microphone 23 and at the position of the ear drum 40 for the two different leakage conditions shown.

Figure 11:
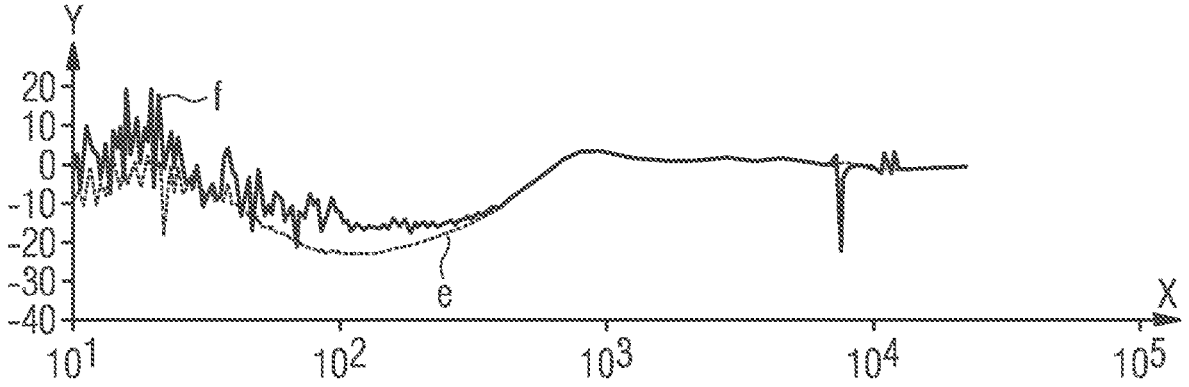
In FIG. 11 the noise cancellation performance of an exemplary embodiment of the audio device is plotted.

In FIG. 11 the feedback noise cancellation performance of an embodiment of the audio device 20 is shown. For the audio device 20 a leak is present between the audio device 20 and the ear canal walls 34. Furthermore, the error microphone 23 is directly coupled to the volume of air within the ear canal 27. On the x-axis the frequency is plotted in Hz and on the y-axis the attenuation is plotted in dB. Curve e refers to the attenuation at the position of the error microphone 23 and curve f refers to the attenuation at the position of the ear drum 40. Noise cancellation over a wide range of frequencies can be achieved at both the position of the error microphone 23 and at the position of the ear drum 40. Thus, for the audio device 20 described herein the quality of the feedback noise cancellation can be improved.

The invention claimed is:

1. A noise cancellation enabled audio device, the audio device comprising a speaker which is arranged within the audio device and which has a preferential side for sound emission, a first cavity enclosing a first volume of air, where the first cavity is arranged at the preferential side for sound emission of the speaker, and an error microphone which is arranged within a second cavity within the audio device, wherein:

the first cavity comprises a first opening to an outside of the audio device and the second cavity comprises a second opening to the outside of the audio device, the first and the second opening are both arranged on a side of the audio device which is arranged to face an ear canal of a user, the error microphone is directly coupled to the volume of air within the ear canal, and the second cavity is separated from the first cavity by a separating wall.

2. The noise cancellation enabled audio device according to claim 1, wherein once the audio device is placed in the ear canal of a user a channel remains in places between the audio device and the ear canal of the user.

3. The noise cancellation enabled audio device according to claim 2, wherein the channel is permeable for air and sound waves.

4. The noise cancellation enabled audio device according to claim 1, wherein the second opening is the only opening in the second cavity.

5. The noise cancellation enabled audio device according to claim 1, wherein the second cavity encloses a second volume of air which is directly coupled to a volume of air within the ear canal of a user in case that the audio device is placed within the ear canal of the user.

6. The noise cancellation enabled audio device according to claim 1, wherein a mesh is arranged over the first opening.

7. The noise cancellation enabled audio device according to claim 1, wherein a mesh is arranged over the second opening.

8. The noise cancellation enabled audio device according to claim 1, wherein the error microphone is arranged to primarily record sound within the ear canal of a user.

9. The noise cancellation enabled audio device according to claim 1, wherein the error microphone acts as a feedback microphone.

10. The noise cancellation enabled audio device according to claim 1, wherein the error microphone is arranged within the second opening at least partially such that the error microphone terminates flush with a housing of the audio device.

11. The noise cancellation enabled audio device according to claim 1, wherein the first and the second opening are arranged adjacent to each other.

12. The noise cancellation enabled audio device according to claim 1, wherein the first opening and the second opening are parallel to one another.

13. The noise cancellation enabled audio device according to claim 1, wherein the first opening and the second opening are not parallel to one another.

14. The noise cancellation enabled audio device according to claim 1, wherein the error microphone is arranged at a shorter distance to the side of the audio device than the speaker.

15. The noise cancellation enabled audio device according to claim 1, wherein a feed-forward microphone is arranged at a side of the audio device which faces away from the side where the error microphone is arranged.

16. The noise cancellation enabled audio device according to claim 15, wherein the feed-forward microphone is arranged to record sound from the environment of the audio device and to provide a noise signal related to the recorded sound.

17. The noise cancellation enabled audio device according to claim 1, wherein the noise cancellation enabled audio device is a headphone.

18. The noise cancellation enabled audio device according to claim 1, wherein the second cavity is delimited by the separating wall, a housing of the audio device, and the second opening.

19. The noise cancellation enabled audio device according to claim 1, wherein the error microphone is directly coupled to the second cavity.

20. The noise cancellation system comprising the audio device according to claim 15, wherein the noise cancellation system comprises a filter which is coupled between the feed-forward microphone and the speaker.

21. The noise cancellation system according to claim 20, wherein the filter is arranged to provide a noise cancellation signal based on the noise signal to the speaker.

22. The noise cancellation system according to claim 21, wherein the noise cancellation signal is further based on an error signal provided by the error microphone where the error signal is related to the sound recorded by the error microphone.

* * * * *